United States Patent [19]

Bone et al.

[11] Patent Number: 4,901,854

[45] Date of Patent: Feb. 20, 1990

[54] LOOP CONNECTED ATTACHMENTS

[75] Inventors: Arnold R. Bone, Needham; Donald L. Bourque, Millis, both of Mass.

[73] Assignee: Dennison Manufacturing Company, Framingham, Mass.

[21] Appl. No.: 250,885

[22] Filed: Sep. 29, 1988

[51] Int. Cl.[4] ..... B65D 85/24

[52] U.S. Cl. ..... 206/343; 206/345; 206/346; 24/711.1; 40/662

[58] Field of Search ..... 206/343, 345, 346; 24/711.1; 40/662, 664

[56] References Cited

U.S. PATENT DOCUMENTS

| | | | |
|---|---|---|---|
| 3,686,717 | 4/1972 | Merser | 40/662 |
| 3,733,657 | 5/1973 | Lankton | 206/343 |
| 3,850,297 | 11/1974 | Merser | 206/346 |
| 4,347,932 | 9/1982 | Furutu | 206/343 |
| 4,417,656 | 11/1983 | Kato | 206/346 |
| 4,534,464 | 8/1985 | Lankton | 206/343 |
| 4,654,935 | 4/1987 | Bone | 206/346 |
| 4,660,718 | 4/1987 | Kato et al. | 206/343 |

*Primary Examiner*—David T. Fidei

*Attorney, Agent, or Firm*—Arthur B. Moore

[57] ABSTRACT

A loop attachment in which each attachment has a plurality of filaments, joined in a loop by a seamless connector. Each attachment is insertable through at least one object and has an elongated filament that extends from a flattened object-penetrating part to the seamless connector. The attachments are formed into an assembly with their flattened penetrating parts connected in a spaced relationship for consecutive detachment.

19 Claims, 5 Drawing Sheets

FIG. 8A
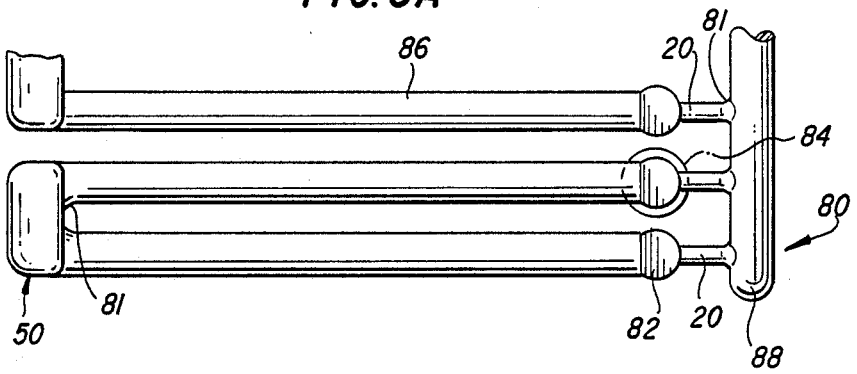
FIG. 8B
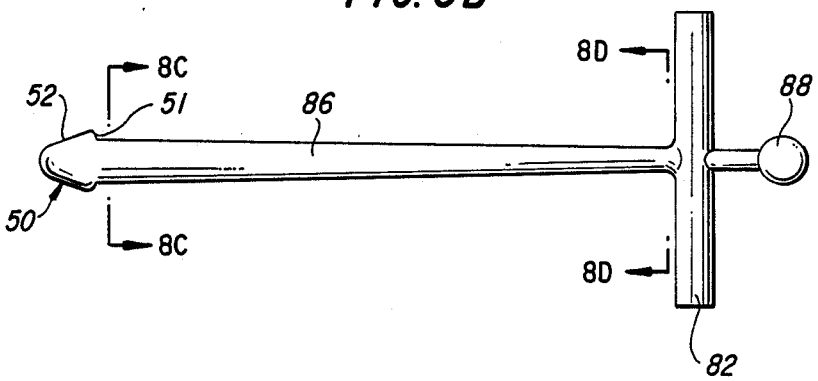
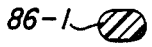
FIG. 8C
FIG. 8D
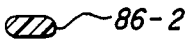
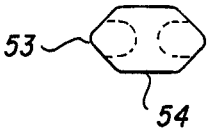
FIG. 8E

LOOP CONNECTED ATTACHMENTS

This invention relates to attachments for the joinder of objects, usually to secure objects together. In particular, the invention relates to attachments which facilitate the pairing of objects.

Attachments for the joinder of objects are disclosed in Bone U.S. Pat. No. 3,444,597, issued May 20, 1969, and in Kirk, U.S. Pat. No. 3,380,122, issued Apr. 30, 1968. Each attachment has an elongated filament-like member with a perpendicular object-penetrating part at one end, and a perpendicular enlarged part at the other end. The object-penetrating part is a cylindrical bar that is capable of passing end-wise through a hole. After the cylindrical bar has passed through the hole, it assumes its normal position substantially perpendicular to the elongated filament-like section. This prevents escape of the attachment in one direction from the attached object. Escape of the attachment in the other direction is prevented by the enlarged portion.

The attachments are generally provided as an assembly or "clip" with 25 or more individual attachments. An attaching device or "gun" of the type disclosed in Bone U.S. Pat. No. 3,103,666, issued Sept. 16, 1963, has a slitted hollow needle which may be used to form the hole in an object, sever a single attachment from an assembly and force the object-penetrating part of the severed attachment through the hole formed in the object.

Attachments similar to those used with an attaching device like that of Bone U.S. Pat. No. 3,103,666, have become widely used in industry. The devices attach tags and labels to articles sold on the retail market. The attachments are effective in preventing shoppers from switching tags by removing a tag from a low-priced article, and substituting it on a higher priced article.

The attachments also are used for securing objects to one another. When used in connection with attaching devices of the Bone type, the attachments may be applied at a rapid rate by even relatively unskilled personnel. This greatly reduces the cost of tagging, labeling, and securing objects to one another. In many commercial settings such attachments have virtually supplanted all other attaching methods.

Certain difficulties, however, have been encountered when it is desired to join two objects, such as matching garments from a set of wearing apparel. The single object-penetrating part of the conventional attachment has made it necessary to insert the needle of the attaching device through both objects simultaneously. The combined thickness of the objects can be a limiting factor. The thickness frequently is too great to allow suitable penetration of the needle and subsequent attaching action. Furthermore, the pressure applied to insert a needle through multiple objects frequently causes undesirable stretching, particularly in the area surrounding needle penetration.

In addition, while prior art attachments have been useful in securing tags and labels to articles, their additional uses have been limited. For example, they cannot simultaneously hang objects which are to be displayed in a suspended position, such as scarves and handkerchiefs. Likewise, they are not capable of forming garment loops or function as thread substitutes in sewing operations.

A modification of the prior art to secure objects of substantial thickness is disclosed in Merser U.S. Pat. No. 3,850,297. While the fasteners of the Merser type are generally useful, their end connections do not have sufficient strength for heavy duty applications.

Accordingly, it is an object of the invention to provide an attachment assembly in which individual attachments can be used readily to secure two or more objects, particularly two or more objects having a substantial combined thickness.

It is a further object to facilitate the use of individual attachments with automated attaching devices.

A further object is to combine individual attachments so that they may be easily inserted into the same or different objects by successive actuations of an attaching device.

Another object is to provide an attachment assembly which permits individual attachments to be inserted into objects and form strengthened loops having a variety of lengths.

Still another object is to provide an attachment assembly which can be manufactured and assembled inexpensively.

SUMMARY OF THE INVENTION

In accomplishing the foregoing and related objects the invention provides an attachment in which individual attachments are provided with flattened object penetrating parts. The flattening of the penetrating parts facilitates manufacture and use of the attachments.

Attachments with plural object penetrating parts make it possible to easily combine two objects by inserting one penetrating part through a first object and another penetrating part through a second object. The two objects are effectively attached without the exertion of substantial pressure to penetrate thicknesses. Attachments with plural object penetrating portions are provided with suitable strength by using a seamless connector to join their filamentary portions.

Similarly, the penetrating parts of an attachment may be inserted through a single object in either the same or different openings. Such an attachment forms its filament section into a looped configuration which can be used for a variety of applications. Examples include hanger loops for skirts, hook loops for coats, tufting for upholstery, and mounting loops for hanging articles.

The penetration by opposite ends of the attachment also suggests use for the sewing of fabrics, providing long, loose stitches required in basting, and holding solid objects to cardboard displays.

Furthermore, the combining of filaments into an integral attachment using a seamless connector also provides a significant strength advantage. In addition each penetrating part of the attachment is integrally connected and strung along a rod by a neck piece. The penetrating parts of individual attachments are consecutively connected by adjacent necks.

Actuation of the attaching device inserts penetrating part through an object, while a filament is still connected to a further penetrating part of the integral assembly. Upon the next actuation of the device, either with the needle remaining in place or removed and inserted elsewhere, the further penetrating part is separated from the assembly. This completes the severing and insertion of the attachment with a strengthened end connector. The arrangement lends itself to high speed fastening, suitable automation for commercial applications. It also minimizes tangling or snagging, as well as breakage and provides flattened penetrating parts that are easier to eject from a mold and easier to feed through a dispensing gun.

DESCRIPTION OF THE DRAWINGS

Other aspects of the invention will appear after considering several illustrative embodiments, taken with the accompanying drawings in which:

FIGS. 8A–8B are front and side views of an alternate embodiment of the invention;

FIGS. 8C–8E are sectional views of the attachments of FIGS. 8A and 8B; and

DETAILED DESCRIPTION

Figure 1A:
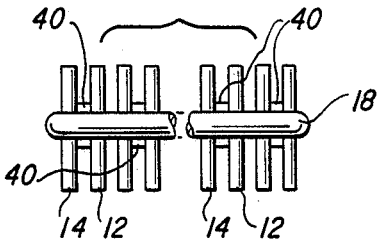
FIGS. 1A–1D are top, front, side and bottom views of an assembly of attachments made in accordance with the present invention.
Figure 1B:
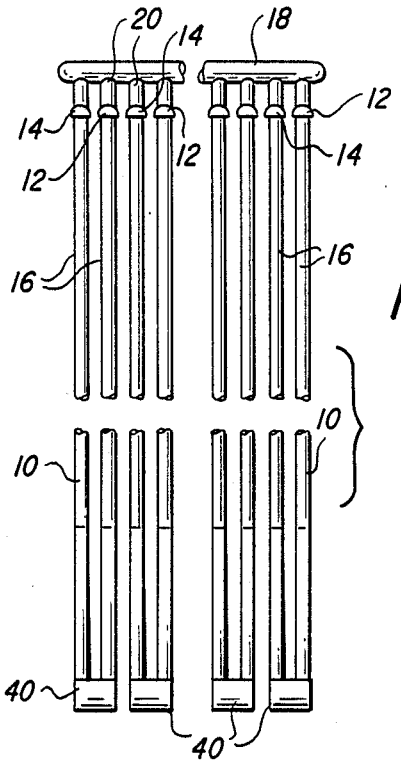
Figure 1C:
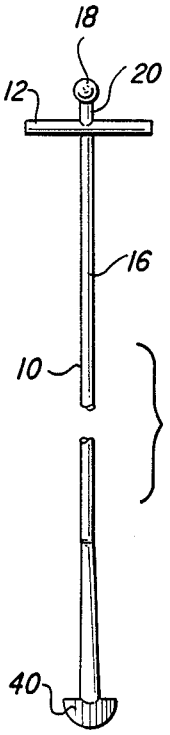
Figure 1D:
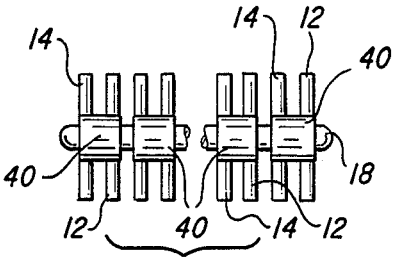
Figure 2:
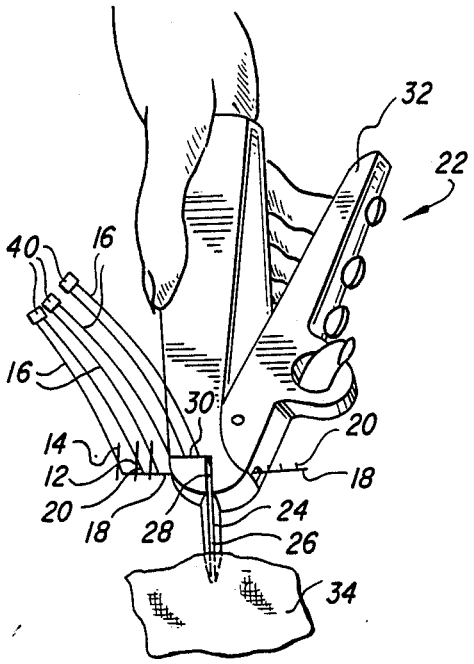
FIG. 2 is a schematic view showing a clip of attachments in accordance with the invention being used with an attaching device for which the needle of the device is about to penetrate an object.
Figure 3:
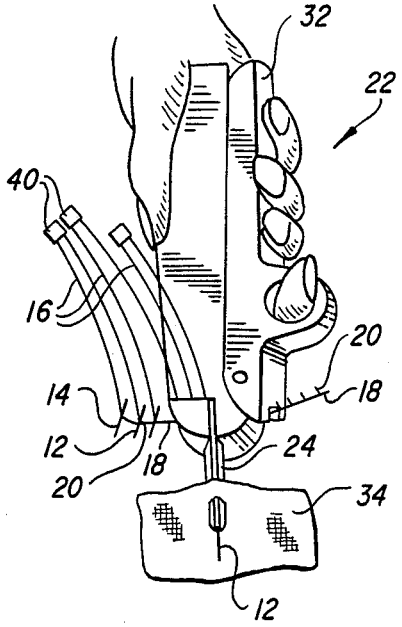
FIG. 3 is a view similar to that in FIG. 1 showing the needle having penetrated the object and the attaching device actuated to sever a first object-penetrating part of an attachment and move it through the needle and the object.
Figure 4:
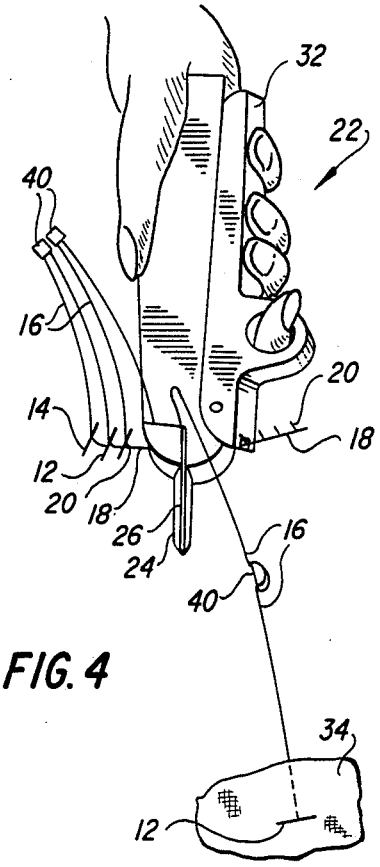
FIG. 4 shows the attaching device having been withdrawn, with the leading attachment connected to the object by its first object-penetrating part.

In the embodiment depicted in FIGS. 1A–1B, each attachment has a bar-like, object-penetrating part 12 at one end, a similar bar-like object penetrating part 14 at the other end and elongated filaments 16 connecting parts 12 and 14 through seamless connector 40 as discussed below. Penetrating parts 12, 14 are illustrated as flattened thin cylinders connected at their midpoints to filaments 16 and extending substantially at right angles to filaments 16 to form a generally T configuration (see FIG. 1C). The penetrating parts are shown in FIG. 1B with a cross section essentially in the form of a circle missing a segment (i.e., a circle missing the minor part defined by a chord). Other flattened cross-sections may also be employed. In operation, as described in more detail below, each penetrating part is inserted along its axial direction through an object, the object being threaded onto the filament 16 adjacent the penetrating part. The penetrating part thereafter serves to retain the object on the filament 16.

Accordingly, each penetrating part 12 or 14 has a length-to-width ratio that is sufficient to prevent the object from slipping off the filament 16. In addition, each penetrating part has a cross sectioned shape that allows it to be threaded through the object without producing an objectionable hole.

Filament 16 has a flattened cross sectional shape which is oriented relative to penetrating parts 12 and 14 to cause the filament to naturally bend during insertion in a compact configuration. Therefore, in the preferred embodiment wherein the object penetrating part extends along an axis of elongation, the filament is flattened with its major axis perpendicular to such axis of elongation in order to naturally bend along the latter axis. This promotes ease of penetration and reduces the hole left by a dispensing needle.

The attachment assembly of the invention (FIG. 1B) includes a plurality of attachments 10 connected together and strung along a mounting rod or runner 18 by narrow severable necks 20.

Each object-penetrating part 12 or 14, is integrally attached to the mounting rod 18 by necks 20. The successive penetrating parts of each individual attachment are connected by adjacently positioned necks 20. In the resulting assembly, the filaments 16 form a looped configuration extending between adjacent penetrating parts 12, 14. These, in turn, are connected to rod 18 by adjacent necks 20. This construction is particularly well suited for use with attaching devices of the type illustrated by Bone U.S. Pat. No. 3,103,666, inasmuch as two consecutive actuations of the device can rapidly (in two steps or operations) sever the attachment from the assembly and insert it through one or more objects.

The ends of adjacent filaments 16 are joined by a seamless connector 40. This provides the loop extremity of the attachment with substantial strength and avoids the kinds of connector failure that can be experienced with some forms of loop fasteners. The connectors 40 also assist in stretching the filaments 16 to improve their tensile strength. The connectors 40 also serve to separate two objects joined by a loop attachment.

The assembly and the individual attachments thereof are preferably integrally molded of a thermoplastic material such as, but not restricted to, nylon. In a typical embodiment of an individual attachment, the filament 16 extends approximately four inches in length while parts 12, 14 are approximately 13/32 in. in length and 0.070 inch in diameter. It should be noted however, that these dimensions may be varied considerably depending upon the particular attachment and its specific end use application.

The manner of use and functioning of the attachment assembly described herein will now be apparent. As is made clear in the Bone U.S. Pat. No. 3,103,666 and as is shown in FIGS. 1–4, the attaching gun generally designated 22 is provided with an object penetrating needle 24 having a slot along one side thereof connecting with a slot 28 on the side of the gun 22 proper. The clip of attachments is adapted to be inserted into gun 22 so that mounting rod or runner 18 passes through the gun 22 along with the object-penetrating parts 12, 14, while the filament section 16 passes through a slot 30 formed in the side of the gun, until the object-penetrating part 12 of the attachment 10 is brought in line with the slotted needle 24. Thereafter when handle 32 of the gun 22 is squeezed, a plunger engages the end of the penetrating part 12 of the leading attachment, causes it to move relative to the neck 20 so as to sever it from the latter, and then pushes penetrating part 12 out through needle 24 with the filament 16 connected thereto, moving along the slots 26 and 28. In order to associate the attachment with one or more objects 34 generally the operator, once he has inserted a clip of attachments into the attaching gun 32, pushes the needle 24 through the object 34, that needle 24 forming a hole in object 34. Then actuation of handle 32 separates the penetrating part 12 of the leading attachment 10 from the remainder of the clip and pushes that part through needle 24 and out the tip of the needle 24. As penetrating part 12 moves past the object 34, the filament 16 is pulled inwardly toward the needle 24 and is bent over onto the trailing portion of part 12 so that it is threaded through object 34 with part 12. It will therefore be apparent that the size of the hole produced in object 34 depends not only on the size of the needle but also on the cross-sectional shape of the filament 16 and of penetrating parts 12 and 14. As part 12 leaves the needle 24, it assumes a position substantially at right angles to the surface of object 34, thus preventing the attachment 10 from disengaging itself from the object 34 when the attaching gun 22 is withdrawn pulling its needle out from object 34. At this point, part 12 is attached to object 34 while filament 16 is still connected to penetrating part 14 which has remained part of the integral assembly in the attaching gun 22.

Thereafter, needle 24 may be retained in the same opening object 34, pushed through a different section of object 34, or pushed through a second object 38. Actuation of handle 32 then separates penetrating part 14 of the leading attachment 10 from the remainder of the clip and pushes that part through needle 24 and out of the tip of needle 24. At this point, attachment 10 is totally severed from the clip. As part 14 leaves the needle 24, it is threaded through the object along with filament 16 and assumes a position substantially at right angles to the surface of the object, thus preventing the attachment 10 from disengaging itself from the object. The inserted attachment 10 now either connects two distinct objects or exhibits a looped configuration in a single object.

Figure 5:
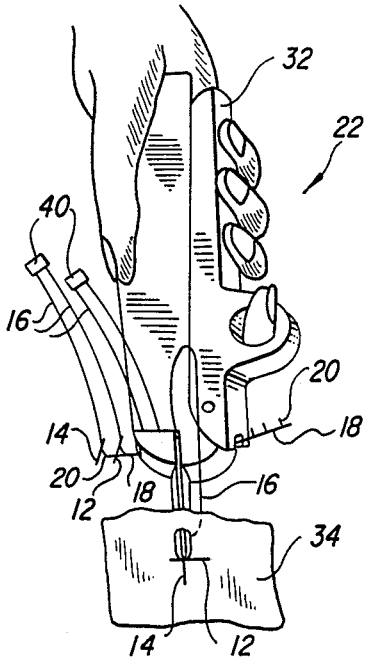
FIG. 5 shows the reinsertion of the needle into the object, so that the attaching device can sever the second object-penetrating part of an attachment and move it through the object.
Figure 7:
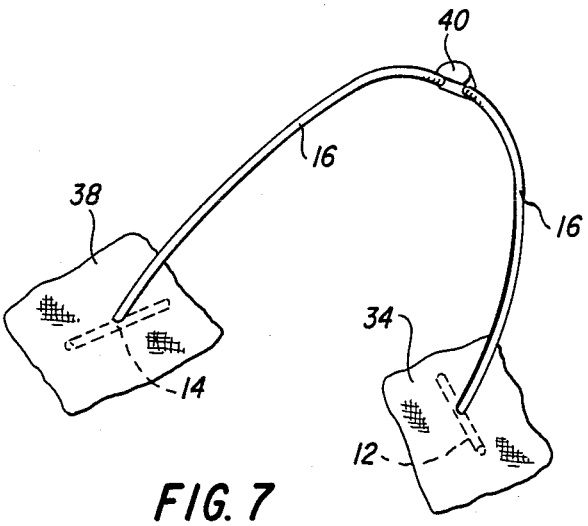
FIG. 7 is a perspective view of an operatively engaged attachment having object-penetrating parts associated with separate objects.

FIG. 5 depicts the situation where penetrating parts 12 and 14 are inserted into object 34 through the same opening 36. It is thus seen that when part 12 has been inserted into object 34 it is merely necessary to retain needle 24 in said opening 36 and actuate gun 22 a second time in the manner described hereinabove. The second actuation will thus sever the still attached penetrating part 14 and push it through needle 24. As penetrating part 14 leaves needle 24 it also assumes a position substantially at right angles to the surface of object 34. Upon removing needle 24 from object 34, it is seen that filament 16 has been formed into a loop configuration which may be used for the various applications previously enumerated.

Figure 6:
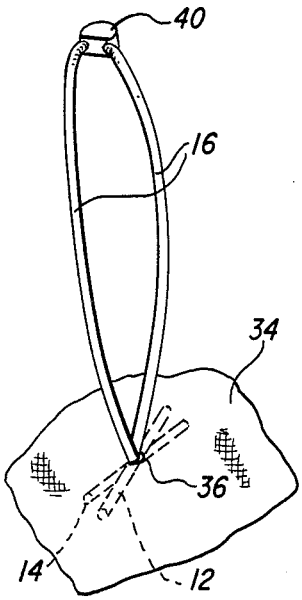
FIG. 6 is a perspective view of an operatively engaged attachment with both object-penetrating parts at a single hole to produce a loop configuration.

FIG. 6 depicts the insertion of parts 12 and 14 into two separate objects 34, 38. Thus, after penetrating part 12 has been inserted into object 34, as indicated above, needle 24 is removed and inserted through object 38. Subsequent actuation of gun 22 severs part 14 and inserts it, in the manner described hereinabove, into object 38 where it assumes a position substantially at right angles to the surface thereof. Upon removal of needle 24, articles 34 and 38 are secured to each other by means of filament 16.

A further possibility is the insertion of the attachment through two separate holes in a single object (not shown). Thus, after the first penetrating part has been inserted through the object, as described hereinabove, the needle is removed and inserted through a second hole in the object. Severing and insertion of the second penetrating part results in an attachment which is either in looped or stitch-type configuration depending upon the length of the attachment and the distance between the respective openings. It is this possibility of forming long, loose stitches that permits these attachments to be used in a basting operation. Thus, rather than pinning up or sewing a hem, temporary securing of the measured hem may be rapidly and effectively achieved by inserting the attachments, in the manner described, at consecutive points along the hem, the distance between the insertion points being slightly less or substantially equal to the length of the filament.

By means of the construction of the present invention, clips of attachments may be formed with the same facility and relative inexpensiveness as is the case with comparable attachments now on the market. The clips disclosed herein will have the significant advantages, however, of containing attachments which exhibit two object-penetrating parts and of being constructed such that both parts may be rapidly and consecutively severed from the assembly and inserted into one or more objects. The construction also prevents tangling of the individual elongated attachments inasmuch as both ends of the attachment are secured to the mounting rod, thus holding the attachments in proper orientation while they remain in the clip. This orientation is also maintained during insertion inasmuch as, subsequent to the insertion of the first penetrating part, the attachment is secured to the first object and to the clip in the gun while preparation is being made for insertion of the second penetrating part.

As previously indicated, the attachments may be utilized to combine two objects; to provide objects with loop attachments which can serve both as conventional attachments as well as mounting means; to function as thread substitutes in various sewing operations; and the like.

A further embodiment of the invention is illustrated in FIG. 8A. Attachments 80 are joined to a runner bar 88 by necks 20. Both of the attachments 20 has a first object-penetrating part 82 connected to one of the neck 20 and a second object-penentrating part 84 attached to an adjoining neck 20. Both of the necks 20 are mounted on the runner bar 88. An elongated filament 86 extends from each object-penetrating part 82 or 84 to an end cap 50. The end cap 50 forms linear bridge between ends of the filament 86. In addition, the filaments are joined to the midpoint of the base for the end cap 50 at a radius 81.

As indicated in the side view of FIG. 8B the end cap 50 is bell shape in the plane that includes the longitudinal axis of one of the connected filaments 86. In addition, there is a ledge 51 that extends outwardly from the filament and joins the sloping side surface 52 of the end cap 50.

FIG. 8C shows the cross-section of the filament 86 at the lines 8C of FIG. 8B, this cross-section 86-1 is ovaloid. A further cross-section taken at position 8D-of FIG. 8B is shown in FIG. 8D and indicates that the cross-section 86-2 is also ovaloid but reduced in cross section to promote stretching which in turn increases flexibility of the filament.

A view of the end cap 50 from the end of the assemblage shows that the end cap has a hexagonal base joining the ends of the filament. The hexagonal base has the configuration of two back-two-back trapazoids. The sides of the hexagon forming the end cap are unequal, with major sides 54 and shortened sides 53.

Figure 9A:
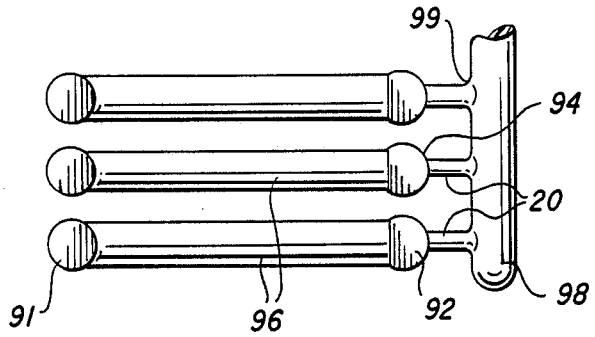
FIGS. 9A–9B are front and side views of another alternate assembly of attachments according to the invention.
Figure 9B:
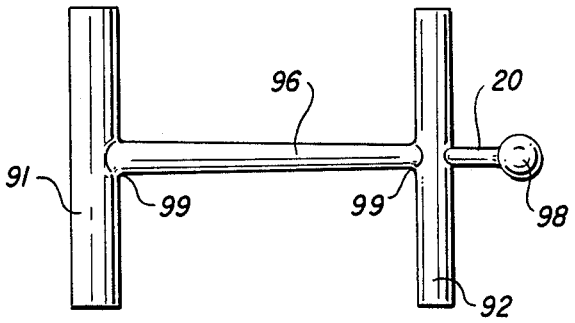

A further embodiment of the inventions appears in FIG. 9A. A runner bar 98 is joined to attachments by necks 20 which connect object-penetrating parts 92 to filaments 96. The end of each filament, as indicated in FIG. 9B, is joined to an enlarged member 91 instead of to an end cap such as the end cap 50 of FIG. 8B.

In a method of manipulating an attachment in which an elongated filament has opposite ends with an object-penetrating part at one end and enlarged part at the other end the steps include molding the attachment with a flattened object-penetrating part of the mold and ejecting the attachment from the mold. The flattened object-penetrating part is molded with a cross-section essentially in the form of a circle missing a segment (i.e. a circle missing the minor part defined by a chord), or a semi-circle. The flat surface of the object-penetrating part desirably extends to the filament and continues on the opposite side of the filament. The flattened object-penetrating part is desirably ejected from a mold using an ejector pin which is smaller in cross-section than the object-penetrating part itself.

In addition the object-penetrating part can be ejected from a dispensing device using an ejector which is smaller in cross-section than the part. The object-penetrating part can be ejected from a dispenser through a slotted hollow needle in which the part engages only a portion of the internal periphial of the needle.

While the invention has been described in terms of the specific embodiments herein, it should be apparent that variations may be developed without departing from the spirit or scope of the invention.

We claim:

1. An improved loop attachment comprising a pair of filaments and a pair of object-penetrating parts, one at an end of each filament, the ends of said filaments opposite said object-penetrating parts being joined by a seamless connector, the improvement wherein each object penetrating part is flattened proximate its junction with the filament, and at least a portion of said filament proximate said junction has a flattened cross-sectional shape with a minor axis parallel to an axis of elongation of the associated object penetrating part, thereby to facilitate the bending of the filament against the object penetrating part.

2. A loop attachment as defined in claim 1 wherein the filament has an oval or ovaloid cross-section with a minor axis parallel to the axis of the object penetrating part.

3. An improved loop attachment comprising a pair of filaments and a pair of object-penetrating parts, one at an end of each filament, the ends of said filaments opposite said object-penetrating parts being joined by a seamless connector, the improvement wherein each object penetrating part is flattened proximate its junction with the filament along a plane substantially perpendicular to the axis of said filament, thereby to facilitate the bending of the filament against the object penetrating part.

4. The attachment of claim 1 further including a mounting element and a severable member between said mounting element and each object-penetrating part; thereby to form a loop attachment assembly with both ends of said attachment, connected to said mounting element.

5. The assembly of claim 4 in which pairs of object-penetrating parts of attachments are arranged sequentially along said mounting element and pairs of said filaments form successive loops on said mounting element.

6. The attachment of claim 1 in which said seamless connector forms an end cap for said filaments with a ledge extending between the ends of said filaments.

7. The assembly of claim 1 in which each of said object-penetrating parts extends substantially at a right angle to its associated filament.

8. The assembly of claim 5 in which said mounting element extends substantially at right angles to both said filaments and said object-penetrating parts.

9. The attachment of claim 6 in which said connector forms a linear bridge between the ends of said filaments.

10. The attachment of claim 6 in which said connector has a hexagonal base joining the ends of said filaments.

11. The attachment of claim 10 in which said hexagonal base has the configuration of two back-to-back trapezoids.

12. The attachment of claim 1 in which said flattened object-penetrating part has a cross-section essentially in the form of a circle missing a segment, or a semi-circle.

13. The attachment of claim 6 in which the cross-section of said connector in a plane that includes the longitudinal axis of a connected one of said filaments is bell-shaped.

14. An attachment as defined in claim 3 wherein said flattened object-penetrating part extends along an axis at a right angle to the longitudinal axis of said filament.

15. An attachment as defined in claim 14 wherein the filament has a noncircular cross section with a minor axis which is parallel to the axis along which the object penetrating part extends.

16. An attachment as defined in claim 5 wherein said object-penetrating part has a cross-section essentially in the form of a circle missing a segment, or a semi-circle.

17. The attachment of claim 3 wherein the object-penetrating part extends along an axis and the filament has a flattened cross-section with a minor axis parallel to the axis of the object-penetrating part.

18. The attachment of claim 3 wherein the cross sectional area of the filament increases with distances away from the object penetrating part.

19. An attachment as defined in claim 18 wherein the filament has an oval or ovaloid cross-section.

* * * * *